US009759151B2

(12) United States Patent
Ito et al.

(10) Patent No.: US 9,759,151 B2
(45) Date of Patent: Sep. 12, 2017

(54) ENGINE CONTROL APPARATUS

(71) Applicant: TOYOTA JIDOSHA KABUSHIKI KAISHA, Toyota-shi (JP)

(72) Inventors: Yoshiyasu Ito, Toyota (JP); Kiyonori Takahashi, Toyota (JP); Takuya Inamasu, Kariya (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 20 days.

(21) Appl. No.: 15/079,069

(22) Filed: Mar. 24, 2016

(65) Prior Publication Data

US 2016/0281626 A1 Sep. 29, 2016

(30) Foreign Application Priority Data

Mar. 27, 2015 (JP) ..... 2015-067269

(51) Int. Cl.

*F02D 41/22* (2006.01)
*F02D 35/00* (2006.01)
*F02D 41/38* (2006.01)
*F02D 41/20* (2006.01)

(52) U.S. Cl.

CPC ..... *F02D 41/22* (2013.01); *F02D 41/221* (2013.01); *F02D 41/3827* (2013.01); *F02D 41/20* (2013.01); *F02D 2041/224* (2013.01); *F02D 2200/0602* (2013.01);
(Continued)

(58) Field of Classification Search

CPC .... F02D 41/22; F02D 41/221; F02D 41/3827; F02D 41/32; F02D 41/14; F02D 41/1402; F02D 41/3818; F02D 35/0092; F02D 2041/224; F02D 2200/602;
(Continued)

(56) References Cited

U.S. PATENT DOCUMENTS 4,423,485 A * 12/1983 Sami ..... F02D 41/408 123/357
6,557,530 B1 * 5/2003 Benson ..... F02D 41/22 123/447
2005/0138997 A1 6/2005 Okumura
(Continued)

FOREIGN PATENT DOCUMENTS

GB 2526322 * 11/2015 ..... F02D 41/22
JP 2003-148215 5/2003
(Continued)

*Primary Examiner* — Lindsay Low
*Assistant Examiner* — George Jin
(74) *Attorney, Agent, or Firm* — Oblon, McClelland, Maier & Neustadt, L.L.P.

(57) ABSTRACT

An engine control apparatus is equipped with a fuel injection amount computation unit, a determination process unit, and an engine abnormality process unit. The determination process unit determines, based on a deviation between a command injection amount and a monitoring injection amount, whether or not there is an abnormality in fuel injection control. An injection amount threshold, which is used to make a determination on an abnormality in fuel injection control, is set larger based on a vehicle speed-associated parameter when the vehicle speed-associated parameter is a value corresponding to a case where a vehicle speed is high than when the vehicle speed-associated parameter is a value corresponding to a case where the vehicle speed is low.

16 Claims, 12 Drawing Sheets

(52) U.S. Cl.
CPC ..... *F02D 2200/0616* (2013.01); *F02D 2200/501* (2013.01); *F02D 2200/602* (2013.01)

(58) Field of Classification Search
CPC ..... F02D 2200/0606; F02D 2200/0602; F02D 2200/501; F02D 2200/0614
See application file for complete search history.

(56) References Cited

U.S. PATENT DOCUMENTS

| | | | | |
|---|---|---|---|---|
| 2009/0326787 | A1* | 12/2009 | Hofmeister ..... | F02D 41/0085 701/104 |
| 2013/0096805 | A1* | 4/2013 | Hoshi ..... | F02D 41/0085 701/104 |
| 2015/0073682 | A1* | 3/2015 | Ito ..... | F02D 41/1402 701/104 |

FOREIGN PATENT DOCUMENTS

| | | |
|---|---|---|
| JP | 2005-188309 | 7/2005 |
| JP | 2013-238203 | 11/2013 |
| JP | 2014-66156 | 4/2014 |

* cited by examiner

〈 DETERMINATION MODE DECISION TABLE 〉

ENGINE CONTROL APPARATUS

INCORPORATION BY REFERENCE

The disclosure of Japanese Patent Application No. 2015-067269 filed on Mar. 27, 2015 including the specification, drawings and abstract is incorporated herein by reference in its entirety.

BACKGROUND OF THE INVENTION

1. Field of the Invention

The invention relates to an engine control apparatus that performs the control of fuel injection amount and the like.

2. Description of Related Art

In an engine that is mounted in a vehicle, the control of fuel injection amount is performed to adjust the output of an engine in accordance with a driver's requirement or the like. As a technology of monitoring an abnormality in fuel injection amount control of the engine, there is an art (a conventional art) in which an abnormality in a fuel injection valve is monitored based on a comparison between a command injection amount (a required injection amount) and an actual injection amount that is calculated from an energization time in opening the fuel injection valve, and a warning is issued or fuel injection is limited as a fail-safe process when there is an abnormality in the fuel injection valve (e.g., see Japanese Patent Application Publication No. 2014-066156 (JP 2014-066156 A)).

By the way, in the aforementioned conventional art, since an abnormality is monitored based on a certain determination criterion, the following problem arises. That is, in the case where the vehicle speed is high and the inter-vehicular distance is longer than at low vehicle speed, even when the excess of the actual injection amount over the command injection amount is large, the driver is unlikely to develop a feeling of strangeness (excessive acceleration). If an abnormality is monitored based on a certain criterion regardless of the vehicle speed without taking this viewpoint into account, the fail-safe process such as the warning, the limitation of fuel injection or the like is executed at high vehicle speed although the driver does not feel the occurrence of excessive acceleration. As a result, the driver may develop a feeling of strangeness.

SUMMARY OF THE INVENTION

The invention has been made in view of such circumstances. The invention provides an engine control apparatus that can restrain an engine abnormality countermeasure (a fail-safe process), which makes a driver develop a feeling of strangeness at high vehicle speed, from being taken.

Thus, according to one aspect of the invention, there is provided an engine control apparatus that is equipped with a fuel injection amount computation unit, a first determination process unit, and an engine abnormality process unit. The fuel injection amount computation unit is configured to compute a command injection amount based on an operation state of an engine. The first determination process unit is configured to (i) obtain a monitoring injection amount that monitors a function of computing the command injection amount, and (ii) make a determination on an abnormality in fuel injection control when a deviation between the command injection amount and the monitoring injection amount is equal to or larger than an injection amount threshold. The injection amount threshold is set larger based on a vehicle speed-associated parameter when the vehicle speed-associated parameter is a value corresponding to a case where a vehicle speed is high than when the vehicle speed-associated parameter is a value corresponding to a case where the vehicle speed is low. The engine abnormality process unit is configured to take an engine abnormality countermeasure when there is an abnormality in the fuel injection control of the engine.

According to another aspect of the invention, there is provided an engine control apparatus that is equipped with a fuel injection amount computation unit, a second determination process unit, and an engine abnormality process unit. The fuel injection amount computation unit is configured to compute a command injection amount based on an operation state of an engine. The second determination process unit is configured to (i) obtain a monitoring injection amount that monitors a function of driving a fuel injection valve based on the command injection amount, and (ii) make a determination on an abnormality in fuel injection control when a deviation between the command injection amount and the monitoring injection amount is equal to or larger than an injection amount threshold. The injection amount threshold is set larger based on a vehicle speed-associated parameter when the vehicle speed-associated parameter is a value corresponding to a case where a vehicle speed is high than when the vehicle speed-associated parameter is a value corresponding to a case where the vehicle speed is low. The engine abnormality process unit is configured to take an engine abnormality countermeasure when there is an abnormality in the fuel injection control of the engine.

According to each of the aforementioned engine control apparatuses, the injection amount threshold, which is used to make a determination on an abnormality in fuel injection control, is set larger based on the vehicle speed-associated parameter when the vehicle speed-associated parameter is a value corresponding to a case where the vehicle speed is high than when the vehicle speed-associated parameter is a value corresponding to a case where the vehicle speed is low. Therefore, it is unlikely to be determined that there is an abnormality at high vehicle speed. Thus, an engine abnormality countermeasure, which makes a driver develop a feeling of strangeness at high vehicle speed, can be restrained from being taken.

Besides, in each of the engine control apparatuses, the first determination process unit or the second determination process unit may be configured to (i) use an accelerator opening degree as the vehicle speed-associated parameter, and (ii) set the injection amount threshold larger when the accelerator opening degree is large than when the accelerator opening degree is small. Furthermore, the first determination process unit or the second determination process unit may be configured to (i) use an engine rotational speed as the vehicle speed-associated parameter, and (ii) set the injection amount threshold larger when the engine rotational speed is high than when the engine rotational speed is low. According to the engine control apparatus configured as described above, a determination on an abnormality in the amount of fuel injection can be made by estimating the vehicle speed from the accelerator opening degree and the engine rotational speed, without employing a vehicle speed sensor.

Besides, in each of the engine control apparatuses, the first determination process unit or the second determination process unit may be configured to confirm that there is an abnormality when a duration time of a state where the deviation between the command injection amount and the monitoring injection amount is equal to or larger than the injection amount threshold is equal to or longer than a time threshold. Also, the engine abnormality process unit may be configured to take the engine abnormality countermeasure based on the confirmation of the first determination process unit. According to the engine control apparatus configured as described above, an abnormality in fuel injection control can be confirmed with accuracy. That is, when a situation where the deviation between the command injection amount and the monitoring injection amount is equal to or larger than the injection amount threshold temporarily arises due to a cause other than an abnormality in fuel injection control, the abnormality is erroneously confirmed in some cases. However, such an inconvenience can be avoided, and an abnormality in fuel injection control can be confirmed with higher accuracy, by confirming the abnormality when the duration time of the state where the deviation is equal to or larger than the injection amount threshold is equal to or longer than the time threshold as described above.

Besides, in each of the engine control apparatuses, the first determination process unit or the second determination process unit may be configured to hold an immediately preceding injection amount threshold when the deviation between the command injection amount and the monitoring injection amount is equal to or larger than the injection amount threshold. According to the engine control apparatus configured as described above, when the vehicle accelerates in a situation where the deviation between the command injection amount and the monitoring injection amount is equal to or larger than the injection amount threshold, the inconvenience of a correct determination on an abnormality being impossible due to a change in the injection amount threshold before the confirmation of the abnormality, which results from a rise in vehicle speed, can be avoided.

Besides, according to still another aspect of the invention, there is provided an engine control apparatus that is equipped with a fuel injection amount computation unit, a first determination process unit, and an engine abnormality process unit. The fuel injection amount computation unit is configured to compute a command injection amount based on an operation state of an engine. The first determination process unit is configured to (i) obtain a monitoring injection amount that monitors a function of computing the command injection amount, (ii) make a determination on an abnormality in fuel injection control based on a vehicle speed-associated parameter, and (iii) make the determination based on a determination criterion that is more unlikely to lead to a determination that there is an abnormality, when the vehicle speed-associated parameter is a value corresponding to a case where a vehicle speed is high than when the vehicle speed-associated parameter is a value corresponding to a case where the vehicle speed is low. The engine abnormality process unit may be configured to take an engine abnormality countermeasure when there is an abnormality in the fuel injection control. It should be noted herein that the first determination process unit may be configured to use each of an accelerator opening degree and an engine rotational speed as the vehicle speed-associated parameter, and set the injection amount threshold larger when the accelerator opening degree is large than when the accelerator opening degree is small. Furthermore, the first determination process unit may be configured to use (i) an engine rotational speed as the vehicle speed-associated parameter, and (ii) set the injection amount threshold larger when the engine rotational speed is high than when the engine rotational speed is low.

In the engine control apparatus configured as described above as well, it is unlikely to be determined that there is an abnormality at high vehicle speed. Therefore, the engine abnormality countermeasure, which makes the driver develop a feeling of strangeness at high vehicle speed, can be restrained from being taken.

Besides, according to still another aspect of the invention, there is provided an engine control apparatus that is equipped with a fuel injection amount computation unit, a second determination process unit, and an engine abnormality process unit. The fuel injection amount computation unit is configured to compute a command injection amount based on an operation state of an engine. The second determination process unit is configured to (i) obtain a monitoring injection amount that monitors a function of driving a fuel injection valve based on the command injection amount, (ii) make a determination on an abnormality in fuel injection control based on a vehicle speed-associated parameter, and (iii) make the determination based on a determination criterion that is more unlikely to lead to a determination that there is an abnormality, when the vehicle speed-associated parameter is a value corresponding to a case where a vehicle speed is high than when the vehicle speed-associated parameter is a value corresponding to a case where the vehicle speed is low. The engine abnormality process unit is configured to take an engine abnormality countermeasure when there is an abnormality in the fuel injection control. It should be noted herein that the second determination process unit may be configured to use (i) an accelerator opening degree as the vehicle speed-associated parameter, and (ii) set the injection amount threshold larger when the accelerator opening degree is large than when the accelerator opening degree is small. Furthermore, the second determination process unit may be configured to (i) use an engine rotational speed as the vehicle speed-associated parameter, and (ii) set the injection amount threshold larger when the engine rotational speed is high than when the engine rotational speed is low.

In the engine control apparatus configured as described above as well, it is unlikely to be determined that there is an abnormality at high vehicle speed. Therefore, the engine abnormality countermeasure, which makes the driver develop a feeling of strangeness at high vehicle speed, can be restrained from being taken.

According to the invention, the engine abnormality countermeasure (the fail-safe process), which makes the driver develop a feeling of strangeness at high vehicle speed, can be restrained from being taken.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

One embodiment of the invention will be described hereinafter based on the drawings. The embodiment of the invention will be described as to a case where the invention is applied to an engine control apparatus for a diesel engine that is mounted in a vehicle. Incidentally, the vehicle is mounted with a transmission (not shown) that is coupled to a crankshaft of the diesel engine.

Figure 1:
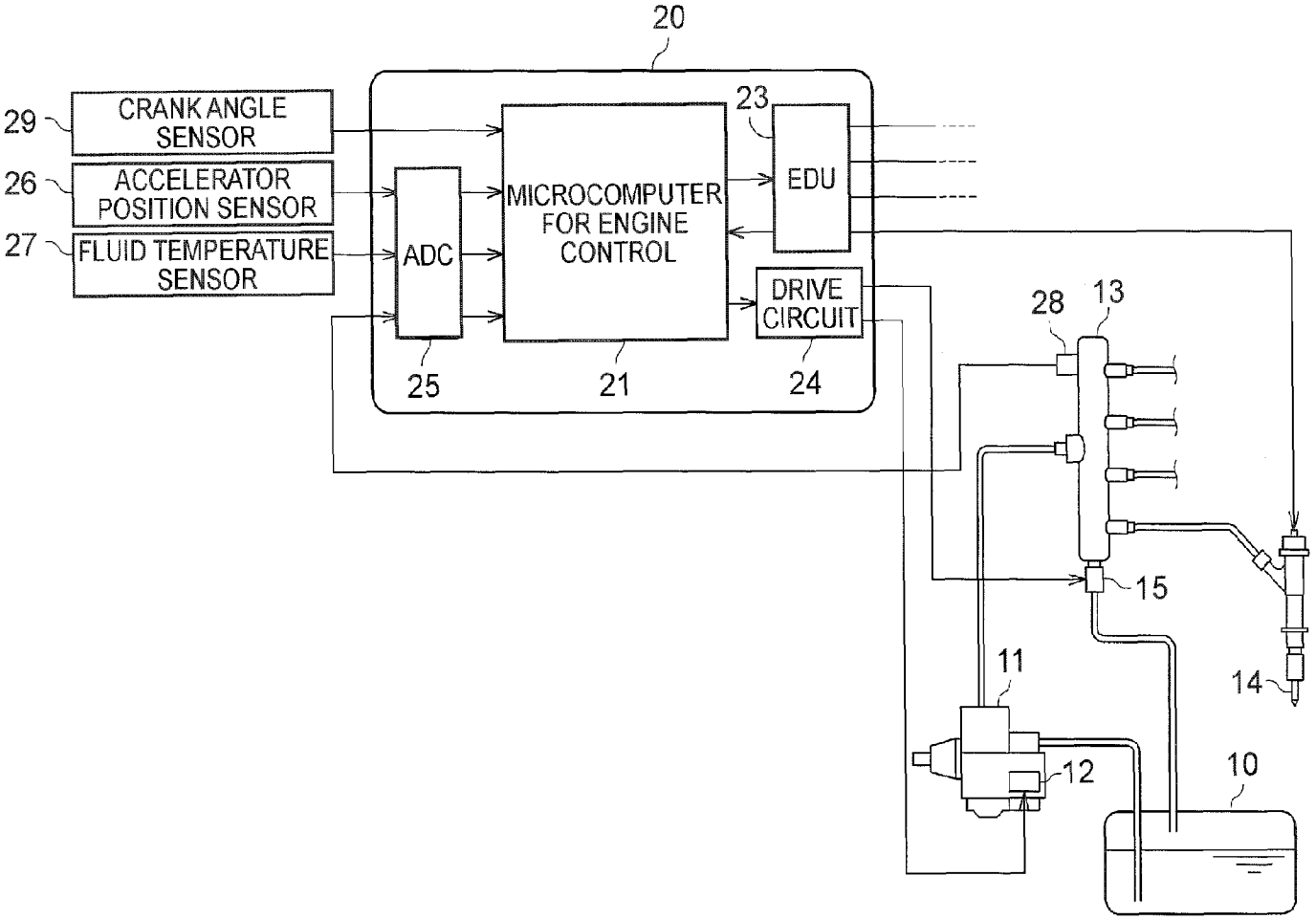
FIG. 1 is a view schematically showing the configuration of an engine control apparatus and a fuel supply system of an engine according to one embodiment of the invention.

First of all, the general configuration of the engine control apparatus and a fuel supply system will be described. FIG. 1 is a view schematically showing the configuration of the engine control apparatus and the fuel supply system of the engine according to the present embodiment of the invention. As shown in this FIG. 1, the fuel supply system of the engine is equipped with a fuel pump 11. This fuel pump 11 pressurizes and discharges the fuel pumped up from a fuel tank 10. The fuel pump 11 is provided with a pressure control valve (a PCV) 12. This PCV 12 adjusts the pressure of the fuel discharged from the fuel pump 11. The fuel discharged by the fuel pump 11 is force-fed to a common rail 13, and is accumulated inside this common rail 13. The fuel accumulated in the common rail 13 is distributed and supplied to injectors (fuel injection valves) 14 of respective cylinders. Incidentally, the common rail 13 is provided with a pressure reducing valve 15. When this pressure reducing valve 15 opens, the fuel inside the common rail 13 is returned to the fuel tank 10. Thus, the fuel pressure (the rail pressure) inside the common rail 13 falls.

The engine that is equipped with the aforementioned fuel supply system is controlled by an engine control apparatus 20. The engine control apparatus 20 is equipped with a microcomputer (a central processing unit (a CPU)) 21, an electronic driving unit (an EDU) 23, and a drive circuit 24. The microcomputer 21 executes various computation processes regarding engine control. The EDU 23 drives the respective injectors 14 in accordance with a command from the microcomputer 21. The drive circuit 24 drives the PCV 12 and the pressure reducing valve 15 in accordance with a command from the microcomputer 21.

On the other hand, detection signals from various sensors such as an accelerator position sensor 26, a fluid temperature sensor 27, a rail pressure sensor 28, a crank angle sensor 29 and the like are input to the engine control apparatus 20. The accelerator position sensor 26 detects an accelerator opening degree ACCP. The fluid temperature sensor 27 detects an engine fluid temperature THW. The rail pressure sensor 28 detects a rail pressure PCR. The crank angle sensor 29 outputs a pulse-like crank angle signal as an engine output shaft rotates. Incidentally, the engine control apparatus 20 is provided with an AD converter (an analog-to-digital converter (an ADC)) 25. The respective detection signals of the accelerator position sensor 26, the fluid temperature sensor 27 and the rail pressure sensor 28 are converted into digital signals by the AD converter 25, and are input to the microcomputer 21. Besides, the crank angle signal output by the crank angle sensor 29 is directly input to the microcomputer 21.

The engine control apparatus 20 configured as described above performs fuel injection amount control as a kind of engine control.

Figure 2:
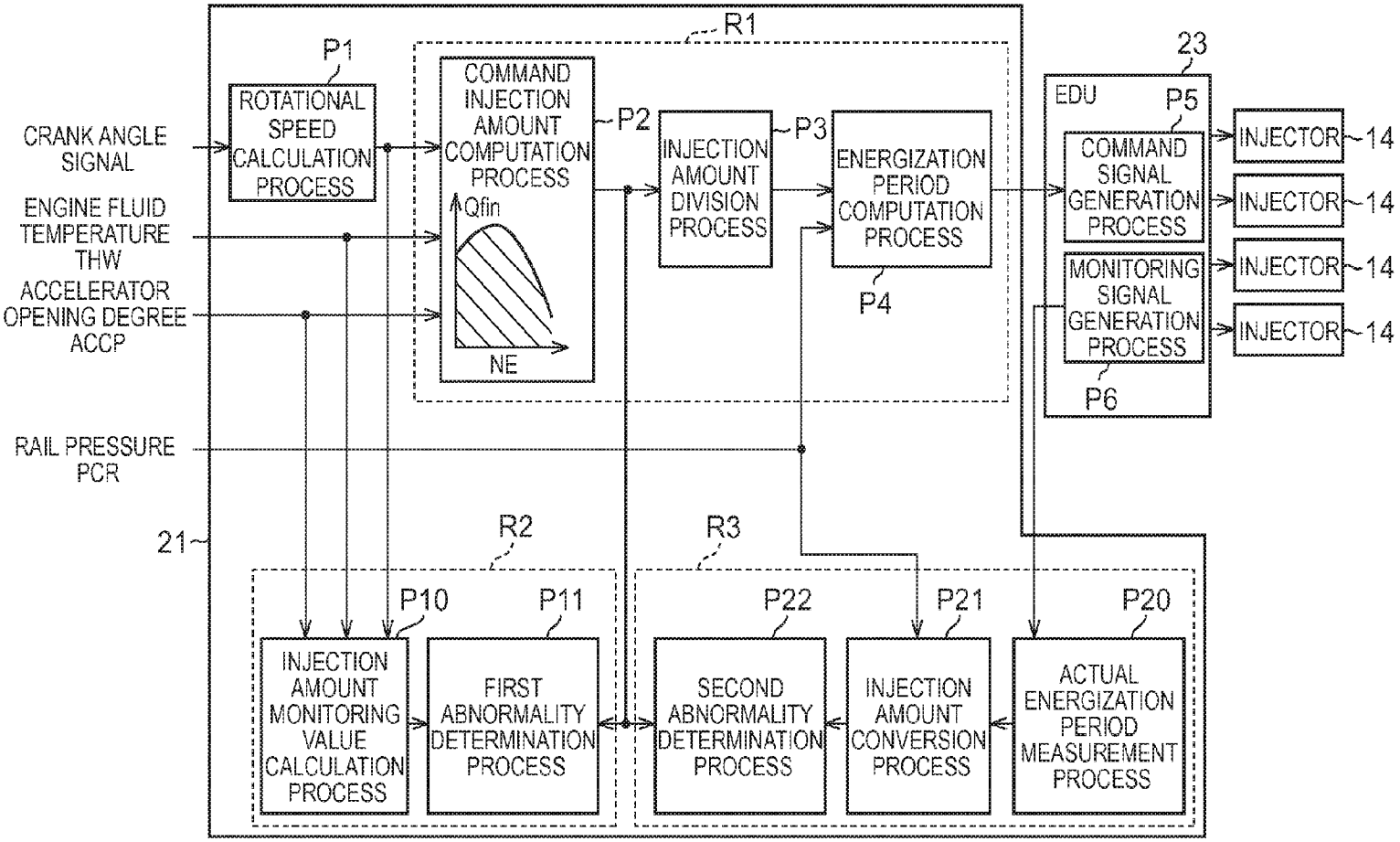
FIG. 2 is a view showing the flow of processes regarding fuel injection control and fuel injection monitoring in the engine control apparatus.

Next, the details of fuel injection amount control will be described. As shown in FIG. 2, the microcomputer 21 executes the process of a fuel injection amount control routine R1 in performing fuel injection amount control. In this fuel injection amount control routine R1, three processes, namely, a command injection amount computation process P2, an injection amount division process P3 and an energization period computation process P4 are executed in calculating an energization period i of an injector driving current.

The command injection amount computation process P2 is a process of obtaining a command injection amount (a required injection amount) Qfin in accordance with an operation state of the engine, and is designed to compute the command injection amount Qfin based on the engine rotational speed NE, the accelerator opening degree ACCP and the like. In computing this command injection amount Qfin, a base injection amount Qbse is first calculated from the engine rotational speed NE and the accelerator opening degree ACCP. The base injection amount Qbse is calculated herein based on a map for calculating the base injection amount, which is stored in the microcomputer 21. A relationship among the engine rotational speed NE, the accelerator opening degree ACCP and the base injection amount Qbse is stored in this map. Then, the computed base injection amount Qbse is corrected with the engine fluid temperature THW or the like. Thus, the command injection amount Qfin is computed.

Incidentally, the engine rotational speed NE is calculated through a rotational speed calculation process P1. In the rotational speed calculation process P1, the engine rotational speed NE is calculated based on the crank angle signal input from the crank angle sensor 29.

In the injection amount division process P3, the command injection amount Qfin is assigned to respective injections, namely, pilot injection, main injection, and after injection. Thus, an injection amount for each of the injections is decided. Incidentally, the number of division of fuel injection and the distribution ratio of the injection amounts for the respective injections are set in accordance with an operating situation of the engine at that moment.

In the energization period computation process P4, the energization period $\tau$ of the injector driving current for each of the injections is computed such that the decided injection amount is obtained. The energization period τ for each of the injections is obtained based on the injection amount for each of the injections and the rail pressure PCR. Then, the microcomputer 21 issues a command of the computed energization period τ for each of the injections to the EDU 23.

The EDU 23 that has received this command executes a command signal generation process P5 for generating an injection command signal based on the energization period τ for each of the injections issued as a command. The injection command signal is generated such that the signal level thereof rises to a level at which an electromagnetic valve of each of the injectors 14 can be opened as soon as the energization period starts, and that the signal level thereof falls to a level at which the electromagnetic valve of each of the injectors 14 cannot be held open as soon as the energization period ends. Then, the generated injection command signal is output to the injector 14 of a relevant one of the cylinders (which is in a combustion stroke).

Besides, the EDU 23 also executes a monitoring signal generation process P6 for detecting a current flowing through the electromagnetic valve of each of the injectors 14 and generating an injection monitoring signal from a result of the detection. The injection monitoring signal is obtained from the energization period of the driving current that is supplied to the electromagnetic valve of each of the injectors 14, and is generated as a pulse-like signal. The signal level of the pulse-like signal is "Lo" while the driving current is actually supplied (while the driving current assumes a value for executing fuel injection from each of the injectors 14), and the signal level of the pulse-like signal is "Hi" while the driving current is not supplied (while the driving current assumes a value for stopping fuel injection from each of the injectors 14). The generated injection monitoring signal is input to the microcomputer 21.

On the other hand, in parallel with fuel injection amount control, the microcomputer 21 constantly monitors whether or not the control is normally performed. In the present embodiment of the invention, fuel injection amount control is thus monitored through the processes of the following two monitoring routines. That is, fuel injection amount control is monitored through a first monitoring routine R2 for monitoring the function of computing the command injection amount Qfin in the fuel injection amount control routine R1, and a second monitoring routine R3 for monitoring the function of driving each of the injectors 14 based on the command injection amount Qfin.

Thus, the first monitoring routine will be described. As shown in FIG. 2, the first monitoring routine R2 is designed to execute two processes, namely, an injection amount monitoring value calculation process P10 and a first abnormality determination process P11.

Figure 3:
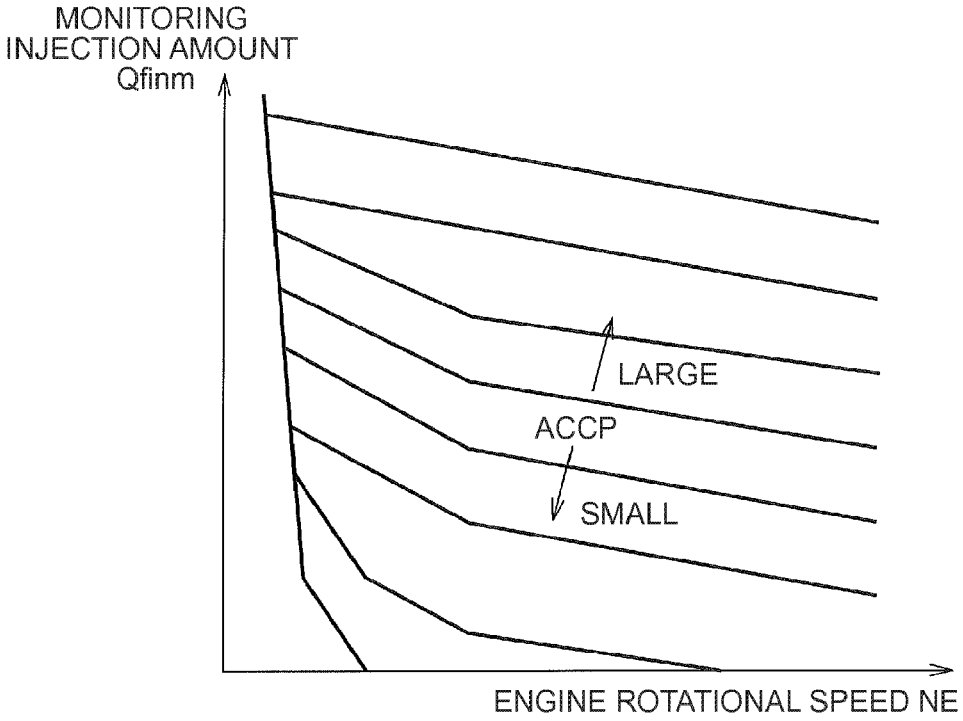
FIG. 3 is a view showing a relationship among an engine rotational speed NE of the engine, an accelerator opening degree ACCP, and a required injection amount monitoring value Qfinm.

In the injection amount monitoring value calculation process P10, a monitoring injection amount Qfinm is calculated with reference to a map for calculating an injection amount monitoring value shown in FIG. 3, based on the engine rotational speed NE, the accelerator opening degree ACCP and the engine fluid temperature THW, which are used to compute the aforementioned command injection amount Qfin. The injection amount monitoring value Qfinm (the monitoring injection amount for monitoring the function of computing the command injection amount) is calculated. Hereinafter, this injection amount monitoring value Qfinm will be referred to also as "the monitoring injection amount Qfinm". Incidentally, the map shown in FIG. 3 is a map showing a relationship among the engine rotational speed NE, the accelerator opening degree ACCP and the monitoring injection amount (a required injection amount monitoring value) Qfinm, and is stored in the microcomputer 21.

In the first abnormality determination process P11, an injection amount difference ΔQ (ΔQ=|Qfin−Qfinm|) between the command injection amount Qfin that is computed in the fuel injection amount control routine R1 and the monitoring injection amount (the required injection amount monitoring value) Qfinm that is calculated in the injection amount monitoring value calculation process P10 is calculated. Then in the first abnormality determination process P11, an abnormality determination process routine (including a process of calculating ΔQ) shown in FIGS. 11 to 15 is executed. The details of the abnormality determination process routine will be described later.

Next, the second monitoring routine will be described. As shown in FIG. 2, the second monitoring routine R3 is designed to execute three processes, namely, an actual energization period measurement process P20, an injection amount conversion process P21 and a second abnormality determination process P22.

In the actual energization period measurement process P20, an energization period of a driving current of each of the injectors 14 is measured based on an injection monitoring signal that is input from the EDU 23, and an energization monitoring period INJM is calculated. The concrete process will be described.

Figure 4:
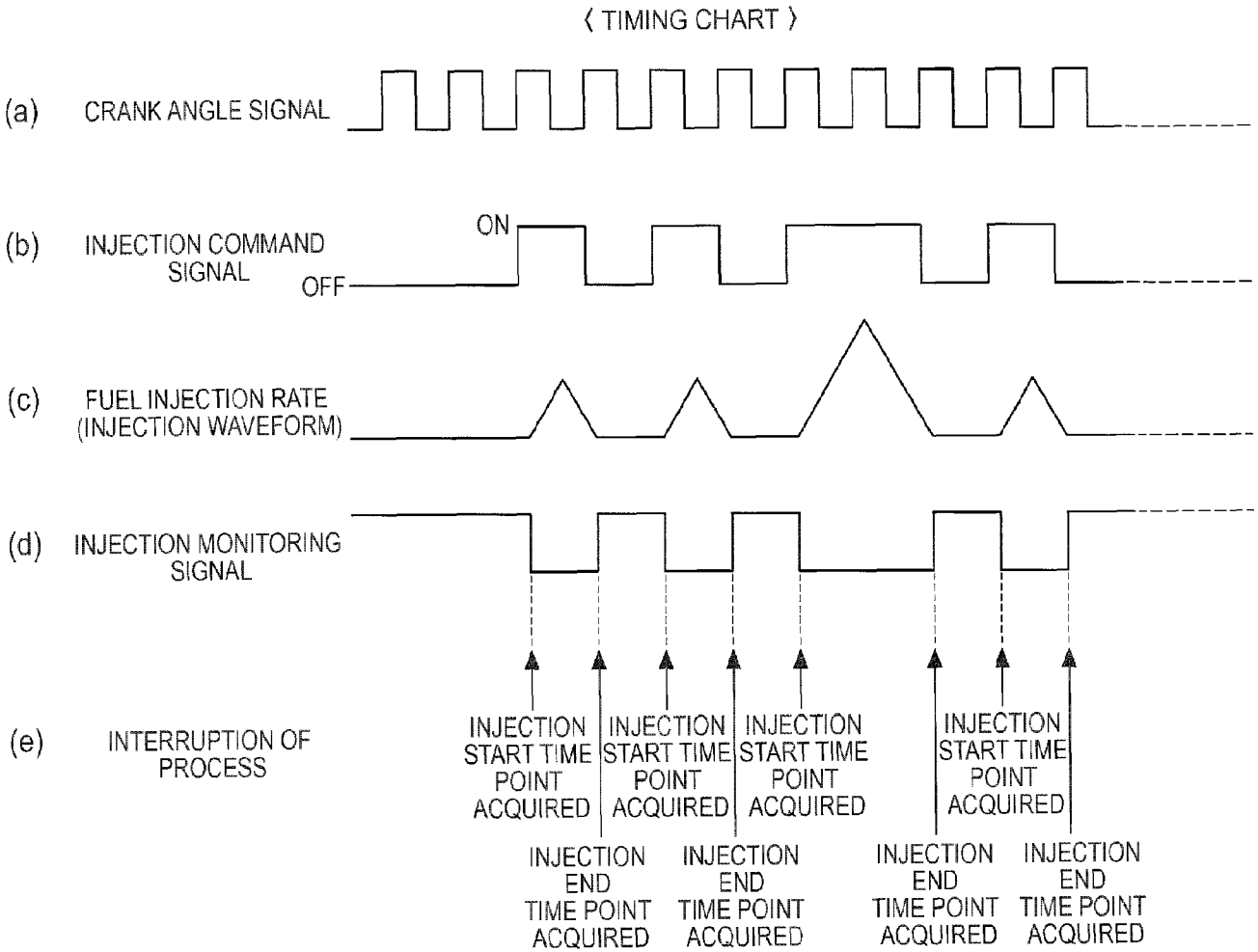
FIG. 4 is a timing chart showing an example of changes in a crank angle signal of the engine, an injection command signal, a fuel injection rate and an injection monitoring signal, and injection time point acquisition timings.

FIG. 4 shows an example of shifts in (a) a crank angle signal, (b) an injection command signal, (c) a fuel injection rate of each of the injectors 14, and (d) an injection monitoring signal. As shown in this FIG. 4, when the signal level of a command signal that is output to each of the injectors 14 by the EDU 23 rises, the driving current that flows through the electromagnetic valve of each of the injectors 14 rises, with a slight delay therefrom, to a level at which the electromagnetic valve can be opened, and fuel injection is started. Then, the injection monitoring signal generated by the EDU 23 is lowered as the driving current increases at this time. After that, when the signal level of the command signal falls, the driving current is stopped, with a slight delay therefrom, from being supplied to the electromagnetic valve of each of the injectors 14, and fuel injection from each of the injectors 14 is stopped. Then, the injection monitoring signal is raised as the driving current is stopped from being supplied at this time.

Then, as shown in FIG. 4 (*e*), the microcomputer 21 fetches a clock time as an interrupt process corresponding to the falling and rising of this injection monitoring signal. That is, the microcomputer 21 acquires the clock time for starting each of the injections and the clock time for ending each of the injections, based on the injection monitoring signal. Then, the microcomputer 21 calculates an energization period of the driving current for each of the injections as the energization monitoring period INJM, from the clock time for starting each of the injections and the clock time for ending each of the injections.

Incidentally, in the present embodiment of the invention, the microcomputer 21 also fetches a pressure of the fuel supplied to each of the injectors 14 (the rail pressure PCR) simultaneously with the reading of this clock time for starting each of the injections and this clock time for ending each of the injections. In this case, the microcomputer 21 acquires the rail pressure PCR that is fetched at the end of each of the injections, as an injection pressure Pcrinj for each of the injections.

In the injection amount conversion process P21, a total injection amount monitoring value ΣQM (an actual injection amount) is calculated using the energization monitoring period INJM for each of the injections, which is calculated in the actual energization period measurement process P20. The concrete process will be described.

Figure 5:
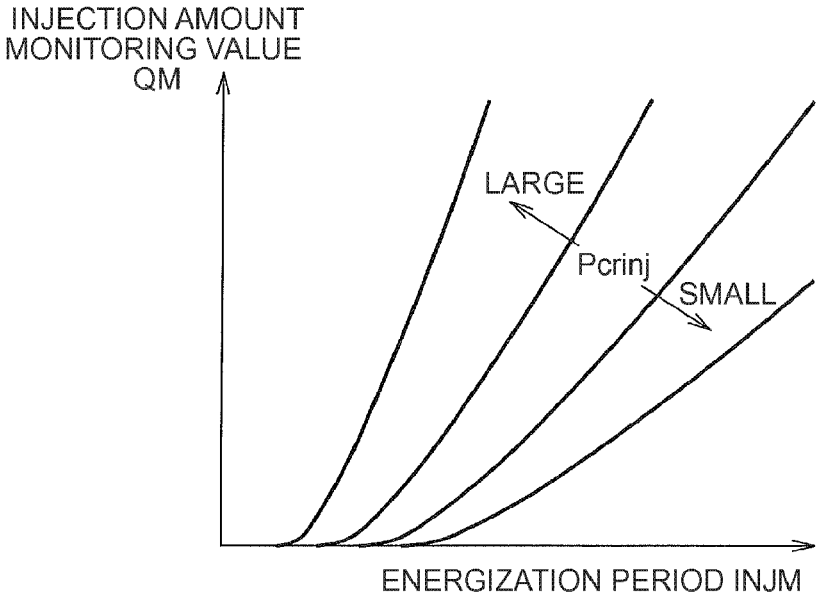
FIG. 5 is a view showing a relationship among an energization monitoring period, an injection pressure, and an injection amount monitoring value in the engine control apparatus.

First of all, an injection amount monitoring value QM of the injection amount for each of the injections is calculated based on the energization monitoring period INJM and the injection pressure Pcrinj for each of the injections. Incidentally, a calculation map showing a relationship among the energization period INJM, the injection pressure Pcrinj and the injection amount monitoring value QM as shown in FIG. 5 is stored in the microcomputer 21. The injection amount monitoring value QM is calculated with reference to this calculation map.

Then, the total injection amount monitoring value ΣQM (the monitoring injection amount for monitoring the function of driving the fuel injection valves based on the command injection amount) is calculated by obtaining a sum of the injection amount monitoring values QM for the respective injections that are calculated in the foregoing process. Incidentally, the total injection amount monitoring value ΣQM thus obtained represents a total amount of the fuel actually injected from the injectors 14 in this series of fuel injections. Hereinafter, the total injection amount monitoring value ΣQM will be referred to also as "the monitoring injection amount ΣQM".

In the second abnormality determination process P22, the injection amount difference ΔQ (ΔQ=|Qfin−ΣQM|) between the command injection amount Qfin that is computed in the fuel injection amount control routine R1 and the monitoring injection amount ΣQM (the total injection amount monitoring value ΣQM) that is calculated in the injection amount conversion process P21 is calculated. Then in the second abnormality determination process P22, the abnormality determination process routine (including the process of calculating ΔQ) shown in FIGS. 11 to 15 is executed. The details of the abnormality determination process routine will be described later.

Next, an abnormality determination process routine that is executed in the first abnormality determination process P11 and the second abnormality determination process P22 will be described.

First of all, [Determination Mode Decision Table] and [Threshold Map] that are used in this abnormality determination process routine will be described.

Next, the determination mode decision table for use in the abnormality determination process routine that is executed in the first abnormality determination process P11 and the second abnormality determination process P22 will be described.

In the present embodiment of the invention, the determination mode is decided in accordance with the vehicle speed. The vehicle speed is estimated from the accelerator opening degree ACCP and the engine rotational speed NE. The details of the process will be described.

First of all, in the present embodiment of the invention, three determination modes, namely, a determination mode 0 (the vehicle speed<10 km/h), a determination mode 1 (10 km/h≤the vehicle speed<30 km/h) and a determination mode 2 (the vehicle speed≤30 km/h) are set with respect to the vehicle speed. One of the three determination modes is decided with reference to the determination mode decision table shown in FIG. 6, based on the accelerator opening degree ACCP and the engine rotational speed NE as parameters regarding the vehicle speed.

Figure 6:
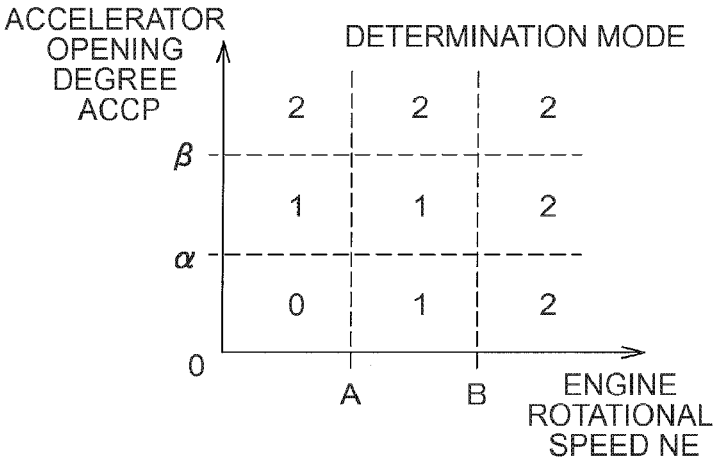
FIG. 6 is a view showing a determination mode decision table in the engine control apparatus.
Figure 7:
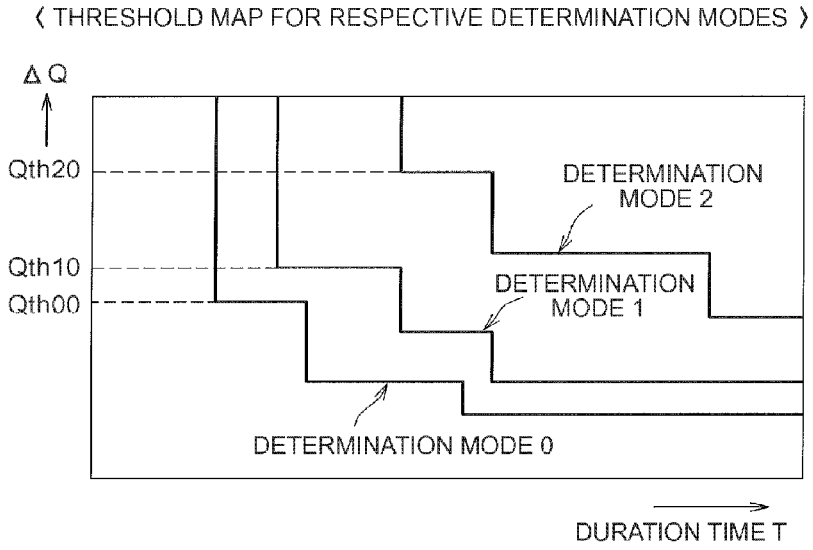
FIG. 7 is a view showing a threshold map for respective determination modes in the engine control apparatus.

The determination mode decision table shown in FIG. 6 is set such that the determination mode shifts toward the high speed side ([the determination mode 0]→[the determination mode 1]→[the determination mode 2]) as the accelerator opening degree ACCP and/or the engine rotational speed NE increase/increases using the accelerator opening degree ACCP and the engine rotational speed NE as parameters.

In the determination mode decision table of FIG. 6, "α" is an accelerator opening degree that enables steady running at the vehicle speed 10 km/h on a flat road when the gearshift speed is the first speed, and "β" is an accelerator opening degree that enables steady running at the vehicle speed 30 km/h on a flat road when the gearshift speed is the first speed. Besides, "A" is the engine rotational speed NE at which the vehicle speed is 10 km/h when the gearshift speed is the first speed, and "B" is the engine rotational speed NE at which the vehicle speed is 30 km/h when the gearshift speed is the first speed. Then, due to this setting, the vehicle speed can be estimated to be equal to or higher than 10 km/h (the vehicle speed≥10 km/h) when "the engine rotational speed≥" or "the accelerator opening degree≥α", and the vehicle speed can be estimated to be equal to or higher than 30 km/h (the vehicle speed≥30 km/h) when "the engine rotational speed≥B" or "the accelerator opening degree≥β". Besides, the vehicle speed can be estimated to be lower than 10 km/h (the vehicle speed<10 km/h) when "the engine rotational speed<A" and "the accelerator opening degree<α".

Incidentally, "A" and "B" in the determination mode decision table of FIG. 6 are set at the first speed where the threshold is rather strict. The reason for this will be described. In the case where the engine rotational speed remains unchanged, when the gearshift speed is equal to or higher than the second speed, the vehicle speed is higher and the inter-vehicular distance is longer than when the gearshift speed is the first speed. Therefore, even when the excess of the monitoring injection amount (Qfinm or ΣQM) over the command injection amount is large, the driver is unlikely to develop a feeling of strangeness. In consequence, the threshold can be made larger when the gearshift speed is equal to or higher than the second speed than when the gearshift speed is the first speed. Accordingly, "A" and "B" are set at the first speed where the threshold is rather strict.

Besides, "α" and "β" are set at the time of steady running when the threshold is rather strict. The reason for this will be described. For example, it is assumed that an ACC (an inter-vehicular distance control apparatus) is utilized or that the driver drives the vehicle following a preceding vehicle in the same manner as the ACC. In this case, as one of the scenes in which the vehicle accelerates, it is possible to mention "a case where the inter-vehicular distance has become longer than when the host vehicle steadily runs". In such a case, the inter-vehicular distance is long. Therefore, even when the excess of the monitoring injection amount (Qfinm or ΣQM) over the command injection amount is large, the driver is unlikely to develop a feeling of strangeness. In consequence, the threshold can be made larger during acceleration than at the time of steady running. Accordingly, "α" and "β" are set at the time of steady running when the threshold is rather strict.

Then, the determination mode can be decided through the use of the determination mode decision table of FIG. 6. In concrete terms, "the determination mode 0" can be decided when "the accelerator opening degree<α" and "the engine rotational speed<A", and "the determination mode 1" can be decided when "α≤the accelerator opening degree<β" and/or "A≤the engine rotational speed<B". Besides, "the determination mode 2" can be determined when "β≤the accelerator opening degree" and/or "B≤ the engine rotational speed".

[Threshold Maps] Threshold maps for use in the abnormality determination process routine that is executed in the first abnormality determination process P11 and the second abnormality determination process P22 will be described with reference to FIGS. 7 to 10.

Each of the threshold maps shown in FIGS. 7 to 10 is a map in which an injection amount threshold (Qth) and a time threshold (Tth) are prescribed using the injection amount difference ΔQ between the command injection amount Qfin and the monitoring injection amount (the required injection amount monitoring value Qfinm or the total injection amount monitoring value ΣQM) and an elapsed time T as parameters. These maps are stored in the microcomputer 21. In the present embodiment of the invention, three modes, namely, the determination mode 0 (the vehicle speed<10 km/h), the determination mode 1 (10 km/h≤the vehicle speed<30 km/h) and the determination mode 2 (30 km/h≤the vehicle speed) are set as the determination modes. The threshold map is set for each of the determination modes.

It should be noted herein that the threshold for each of the determination modes is set in consideration of the inter-vehicular distance that is assumed at the vehicle speed, in each of the threshold maps of FIGS. 7 to 10. In concrete terms, as a rule, as the vehicle speed rises, the inter-vehicular distance increases and the permissible vehicle acceleration (the vehicle acceleration leading to danger) increases. Therefore, the threshold is set in such a manner as to increase as the determination mode shifts toward the high speed side. More specifically, for example, an injection amount threshold Qth10 for the determination mode 1 (10 km/h the vehicle speed<30 km/h) is set larger than an injection amount threshold Qth0 for the determination mode 0 (the vehicle speed<10 km/h), and an injection amount threshold Qth20 for the determination mode 2 (30 km/h≤the vehicle speed) is set larger than the injection amount threshold Qth10 for the determination mode 1. Besides, by the same token, the time threshold (Th) is also set to a value that increases as the determination mode shifts toward the high speed side ([the determination mode 0]→[the determination mode 1]→[the determination mode 2]).

Besides, in the threshold maps of FIGS. 7 to 10, three injection amount thresholds (Qth) and three time thresholds (Tth) are set as to each one of the determination modes.

Figure 8:
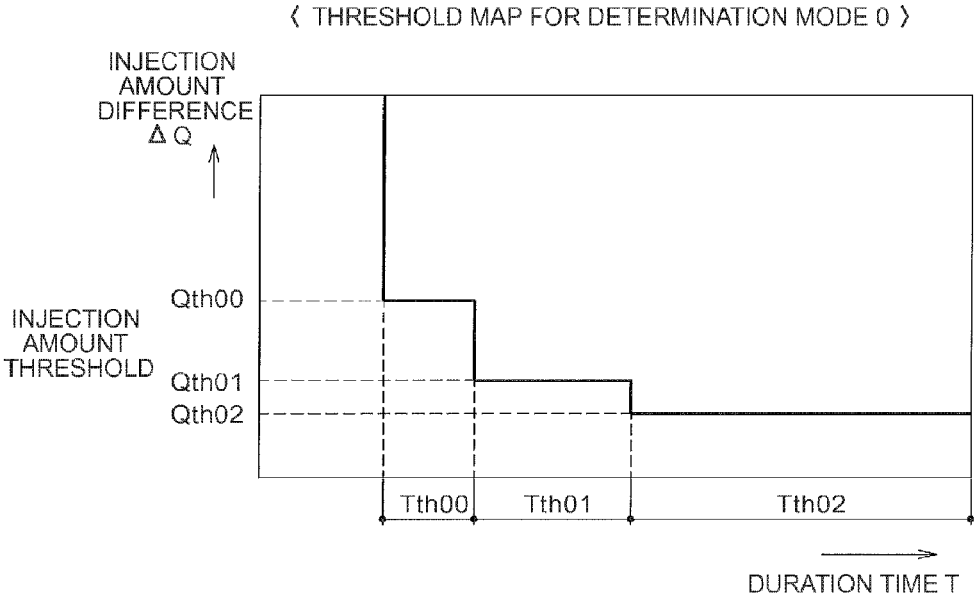
FIG. 8 is a view showing a threshold map for the determination mode 0 in the engine control apparatus.

In concrete terms, in the determination mode 0 shown in FIG. 8, three injection amount thresholds (Qth00>Qth01>Qth02) that are different in magnitude from one another, namely, the injection amount threshold Qth00, the injection amount threshold Qth01 and the injection amount threshold Qth02 are set as to the injection amount threshold (Qth ($mm^3$/st)). Besides, as for the time threshold (Tth (ms)), the time threshold (Tth) is set to a value that increases (Tth00<Tth01<Tth02) as the injection amount threshold (Qth) decreases, in consideration of the fact that the likelihood of the driver developing a feeling of strangeness decreases as the injection amount difference ΔQ (the amount of excess of the monitoring injection amount (Qfinm or ΣQM) over the command injection amount) decreases. In this threshold map of FIG. 8, for example, when the duration time of a state where the injection amount difference ΔQ is equal to or larger than the injection amount threshold Qth00 is equal to or longer than the time threshold Th00, it can be determined that there is an abnormality in fuel injection control (an abnormality in computing the command injection amount or an abnormality in driving any one of the injectors). Besides, when the duration time of a state where the injection amount difference ΔQ is equal to or larger than the injection amount threshold Qth02 is equal to or longer than the time threshold Tth02, it can be determined that there is an abnormality in fuel injection control.

Figure 9:
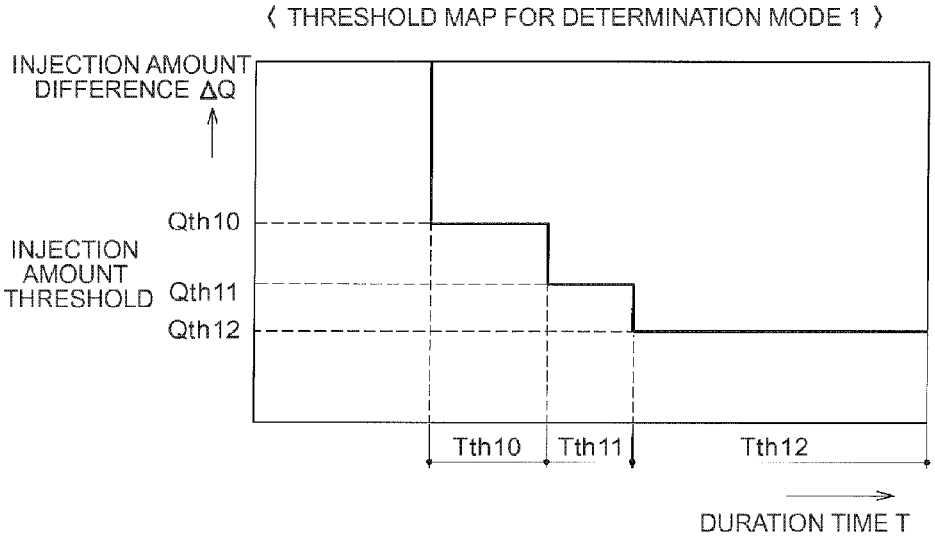
FIG. 9 is a view showing a threshold map for the determination mode 1 in the engine control apparatus.

In the threshold map for the determination mode 1 in FIG. 9 as well, by the same token, three injection amount thresholds (Qth10>Qth11>Qth12), namely, the injection amount threshold Qth10, the injection amount threshold Qth11 and the injection amount threshold Qth12, and three time thresholds (Tth10<Tth11<Tth12), namely, a time threshold Tth10, a time threshold Tth11 and a time threshold Tth12 are set. Besides, in the threshold map for the determination mode 2 in FIG. 10 as well, by the same token, three injection amount thresholds (Qth20>Qth21>Qth22), namely, the injection amount threshold Qth20, the injection amount threshold Qth21 and the injection amount threshold Qth22, and three time thresholds (Tth20<Tth21<Tth22), namely, the time threshold Tth20, the time threshold Tth21 and the time threshold Tth22 are set.

It should be noted, however, that there are relationships [Qth00<Qth10<Qth20], [Qth01<Qth11<Qth21] and [Qth02<Qth12<Qth22] among the three determination modes as to the injection amount threshold (Qth), and that there are relationships [Tth00<Tth10<Tth20], [Tth01<Tth11<Tth21] and [Tth02<Tth12<Tth22] among the three determination modes as to the time threshold (Tth).

Incidentally, the respective values of the injection amount threshold (Qth) and the time threshold (Tth) in each of the threshold maps of FIGS. 7 to 10 are adapted through an experiment, a simulation or the like in consideration of the inter-vehicular distance (the permissible vehicle acceleration) that is assumed at the vehicle speed.

Besides, the injection amount threshold (Qth) and the time threshold (Tth) in the threshold map for use in the abnormality determination process routine of the first abnormality determination process P11, and the injection amount threshold (Qth) and the time threshold (Tth) in the threshold map for use in the abnormality determination process routine of the second abnormality determination process P22 may be set to values that are equal to each other respectively or different from each other respectively.

Next, an exemplary abnormality determination process that is executed in each of the first abnormality determination process P11 and the second abnormality determination process P22 will be described with reference to flowcharts of FIGS. 11 to 15. The abnormality determination process routine of these FIGS. 11 to 15 is repeatedly executed at intervals of 8 milliseconds by the microcomputer 21. Incidentally, the abnormality determination process routine of the first abnormality determination process P11 and the abnormality determination process routine of the second abnormality determination process P22 may be executed as parallel processes or individually.

In this abnormality determination process, three abnormality counters, namely, an abnormality counter C00 for the determination mode 00, an abnormality counter C01 for the determination mode 01 and an abnormality counter C02 for the determination mode 02 are employed as abnormality counters for the determination mode 0. Besides, three abnormality counters, namely, an abnormality counter C10 for the determination mode 10, an abnormality counter C11 for the determination mode 11 and an abnormality counter C12 for the determination mode 12 are employed as abnormality counters for the determination mode 1. Furthermore, three abnormality counters, namely, an abnormality counter C20 for the determination mode 20, an abnormality counter C21 for the determination mode 21 and an abnormality counter C22 for the determination mode 22 are employed as abnormality counters for the determination mode 2. These nine abnormality counters are built in the microcomputer 21. Incidentally, all the initial values of the nine abnormality counters C00 to C02, C10 to C12 and C20 to C22 are 0 (a count value C=0).

When the abnormality determination process routine of FIGS. 11 to 15 is started, the injection amount difference ΔQ is first calculated in step ST101. In concrete terms, in the first abnormality determination process P11, as described above, the injection amount difference ΔQ (ΔQ=|Qfin·Qfinm|) between the command injection amount Qfin that is computed in the fuel injection amount control routine R1 and the monitoring injection amount (the required injection amount monitoring value) Qfinm that is calculated in the injection amount monitoring value calculation process P10 is calculated. In the second abnormality determination process P22, as described above, the injection amount difference ΔQ (ΔQ=|Qfin−ΣQM|) between the command injection amount Qfin that is computed in the fuel injection amount control routine R1 and the monitoring injection amount ΣQM (the total injection amount monitoring value ΣQM) that is calculated in the injection amount conversion process P21 is calculated.

Next, the operation of the abnormality counters for the determination mode 0 will be described. Subsequently in step ST102, it is determined whether or not the injection amount difference ΔQ that is calculated in the aforementioned step ST101 (hereinafter referred to simply as "the injection amount difference ΔQ") is equal to or larger than the injection amount threshold Qth00 in the threshold map (for the determination mode 0) of FIG. 8. If the result of the determination is affirmative (YES), the abnormality counter C00 for the determination mode 00 is incremented (C+1) in step ST103, and a transition to step ST105 is made. If the result of the determination in step ST102 is negative (NO), the abnormality counter C00 for the determination mode 00 is cleared in step ST104, and a transition to step ST105 is made.

It should be noted herein that when the state where ΔQ≥Qth00 continues, the count value of the abnormality counter C00 for the determination mode 00 increases by 1 every time the present process routine is executed at intervals of 8 milliseconds. Besides, when ΔQ becomes smaller than Qth00 (ΔQ<Qth00) before the duration time of the state where ΔQ≥Qth00 reaches a later-described duration time Ctm00 that is based on the count value of the abnormality counter C00 for the determination mode 00, the abnormality counter C00 for the determination mode 00 is cleared at that moment, and the count value becomes equal to 0. This point holds true for all the other abnormality counters.

In step ST105, it is determined whether or not the injection amount difference ΔQ is equal to or larger than the injection amount threshold Qth01 in the threshold map (for the determination mode 0) of FIG. 8. If the result of the determination is affirmative (YES), the abnormality counter C01 for the determination mode 01 is incremented (C+1) in step ST106, and a transition to step ST108 is made. If the result of the determination in step ST105 is negative (NO), the abnormality counter C01 for the determination mode 01 is cleared in step ST107, and a transition to step ST108 is made.

In step ST108, it is determined whether or not the injection amount difference ΔQ is equal to or larger than the injection amount threshold Qth02 in the threshold map (for the determination mode 0) of FIG. 8. If the result of the determination is affirmative (YES), the abnormality counter C02 for the determination mode 02 is incremented (C+1) in step ST109, and a transition to step ST111 is made. If the result of the determination in step ST108 is negative (NO), the abnormality counter C02 for the determination mode 02 is cleared in strep ST110, and a transition to step ST111 is made.

Figure 12:
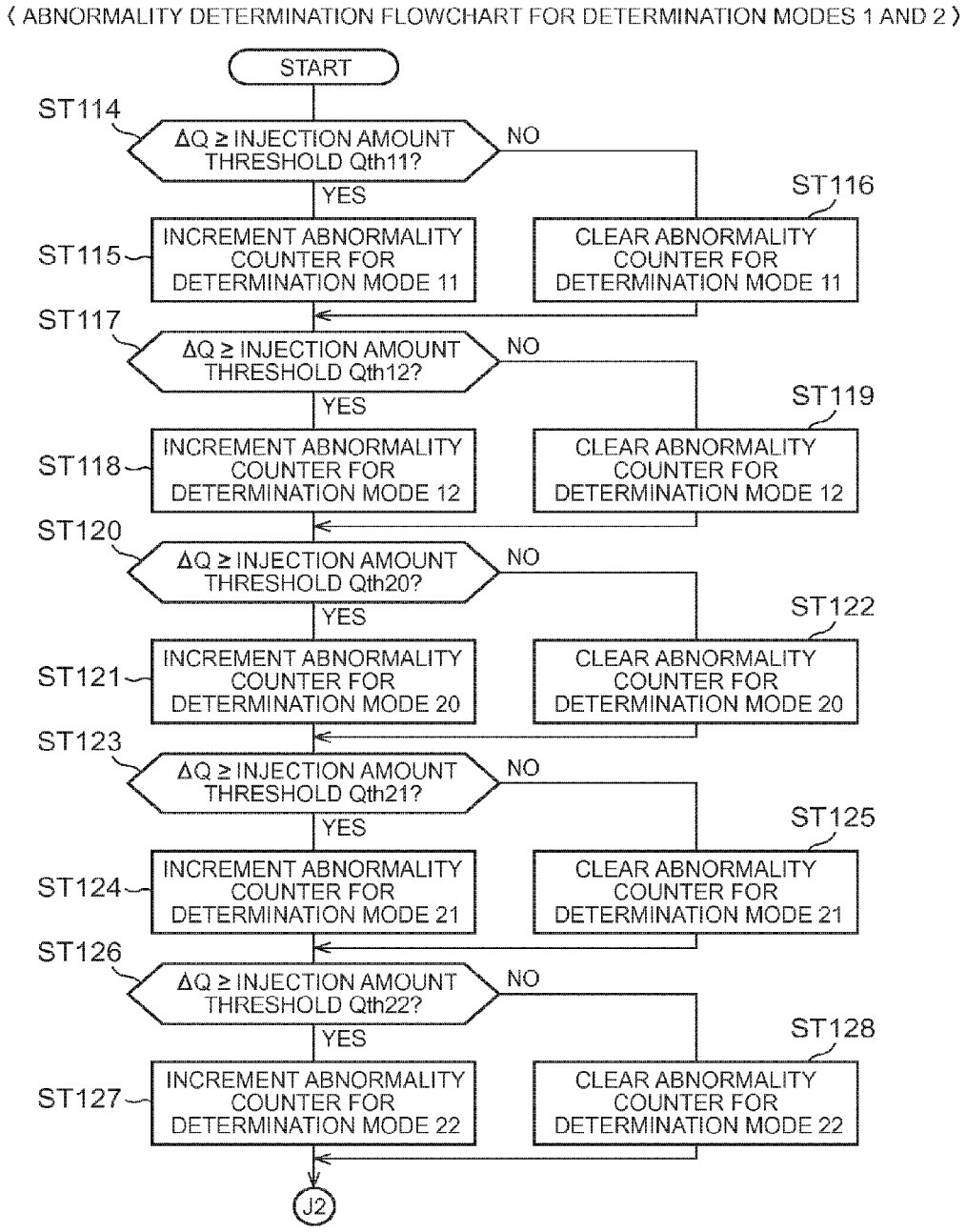
FIG. 12 is a flowchart showing the procedure of an abnormality determination process for the determination modes 1 and 2 in the engine control apparatus.

Next, the operation of the abnormality counters for the determination mode 1 will be described. In step ST111, it is determined whether or not the injection amount difference ΔQ is equal to or larger than the injection amount threshold Qth10 in the threshold map (for the determination mode 1) of FIG. 9. If the result of the determination is affirmative (YES), the abnormality counter C10 for the determination mode 10 is incremented (C+1) in step ST112, and a transition to step ST114 of FIG. 12 is made. If the result of the determination in step ST111 is negative (NO), the abnormality counter C10 for the determination mode 10 is cleared in step ST113, and a transition to step ST114 is made.

In step ST114, it is determined whether or not the injection amount difference ΔQ is equal to or larger than the injection amount threshold Qth11 in the threshold map (for the determination mode 1) of FIG. 9. If the result of the determination is affirmative (YES), the abnormality counter C11 for the determination mode 11 is incremented (C+1) in step ST115, and a transition to step ST117 is made. If the result of the determination in step ST114 is negative (NO), the abnormality counter C10 for the determination mode 10 is cleared in step ST116, and a transition to step ST117 is made.

In step ST117, it is determined whether or not the injection amount difference ΔQ is equal to or larger than the injection amount threshold Qth12 in the threshold map (for the determination mode 1) of FIG. 9. If the result of the determination is affirmative (YES), the abnormality counter C12 for the determination mode 12 is incremented (C+1) in step ST118, and a transition to step ST120 is made. If the result of the determination in step ST117 is negative (NO), the abnormality counter C12 for the determination mode 12 is cleared in step ST119, and a transition to step ST120 is made.

Next, the operation of an abnormality counter for the determination mode 2 will be described. In step ST120, it is determined whether or not the injection amount difference ΔQ is equal to or larger than the injection amount threshold Qth20 in the threshold map (for the determination mode 2) of FIG. 10. If the result of the determination is affirmative (YES), the abnormality counter C20 for the determination mode 20 is incremented (C+1) in step ST121, and a transition to step ST123 is made. If the result of the determination in step ST120 is negative (NO), the abnormality counter C20 for the determination mode 20 is cleared in step ST122, and a transition to step ST123 is made.

Figure 10:
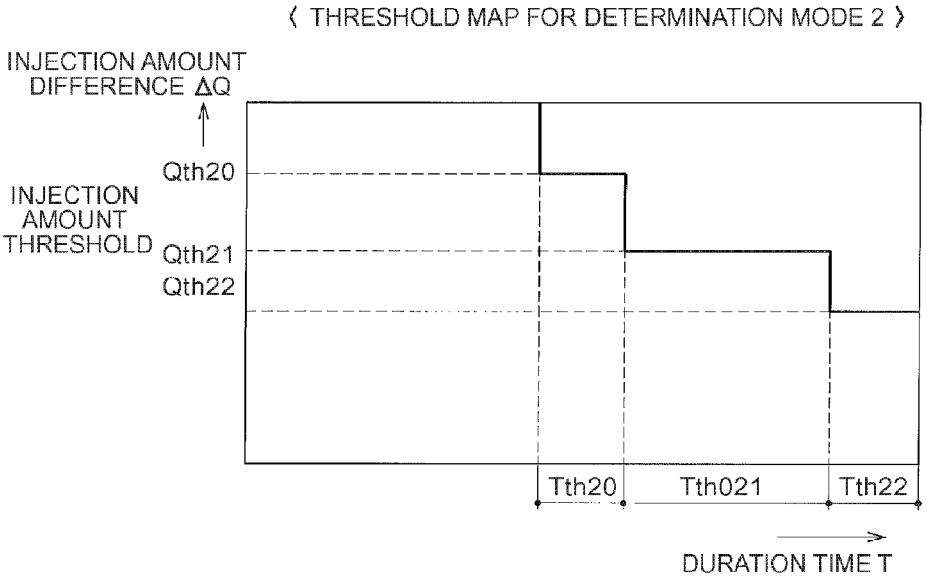
FIG. 10 is a view showing a threshold map for the determination mode 2 in the engine control apparatus.
Figure 11:
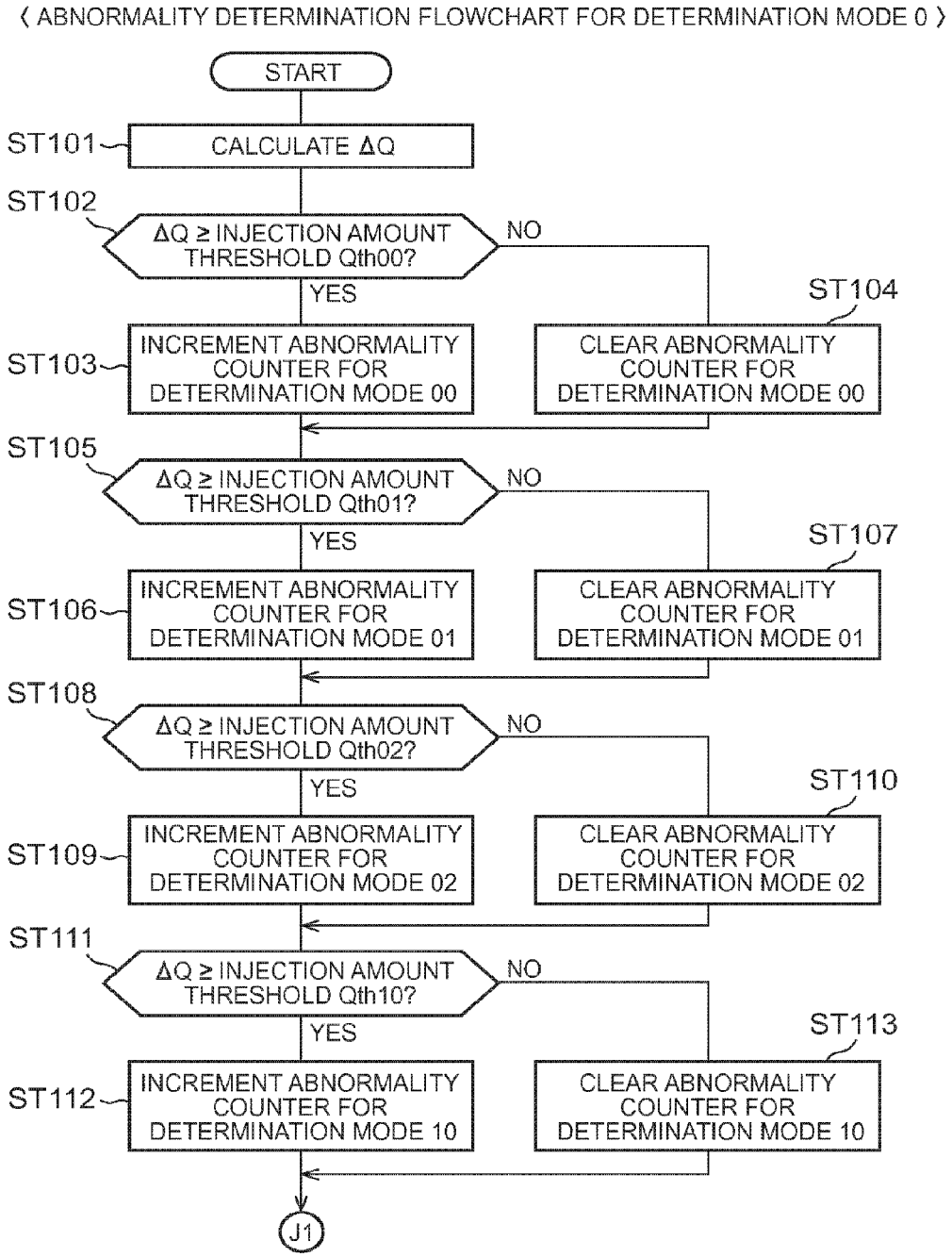
FIG. 11 is a flowchart showing the procedure of an abnormality determination process for the determination mode 0 in the engine control apparatus.

In step ST123, it is determined whether or not the injection amount difference ΔQ is equal to or larger than the injection amount threshold Qth21 in the threshold map (for the determination mode 2) of FIG. 10. If the result of the determination is affirmative (YES), the abnormality counter C21 for the determination mode 21 is incremented (C+1) in step ST124, and a transition to step ST126 is made. If the result of the determination in step ST123 is negative (NO), the abnormality counter C21 for the determination mode 21 is cleared in step ST125, and a transition to step ST126 is made.

Figure 13:
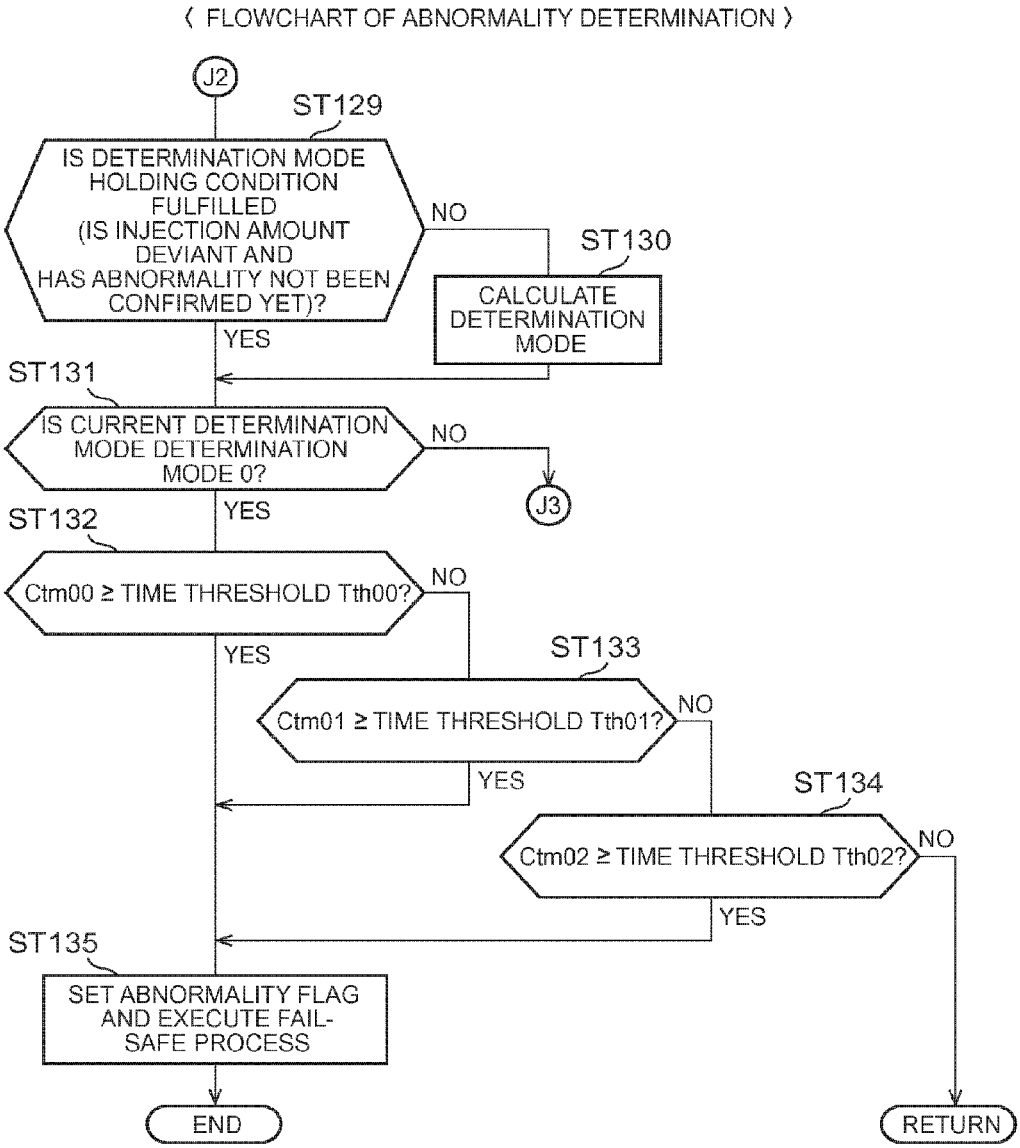
FIG. 13 is a flowchart showing the procedure of an abnormality determination process in the engine control apparatus.

In step ST126, it is determined whether or not the injection amount difference ΔQ is equal to or larger than the injection amount threshold Qth22 in the threshold map (for the determination mode 2) of FIG. 10. If the result of the determination is affirmative (YES), the abnormality counter C22 for the determination mode 22 is incremented (C+1) in step ST127, and a transition to step ST129 of FIG. 13 is made. If the result of the determination in step ST126 is negative (NO), the abnormality counter C22 for the determination mode 22 is cleared in step ST128, and a transition to step ST129 is made.

In step ST129 shown in the flowchart of FIG. 13, it is determined whether or not a determination mode holding condition is fulfilled. In concrete terms, it is determined whether or not the injection amount difference ΔQ has become equal to or larger than one of the nine injection thresholds (Qth) shown in FIGS. 8 to 10. If the result of the determination is negative (NO) (if there is no deviation in injection amount), a transition to step ST130 is made. In step ST130, a current determination mode (the determination mode 0, the determination mode 1 or the determination mode 2) is calculated with reference to the determination mode decision table of FIG. 6, based on a crank angle signal from the crank angle sensor 29 and an accelerator opening degree signal from the accelerator position sensor 26. After that, a transition to step ST131 is made. On the other hand, if the result of the determination in step ST129 is affirmative (YES) (if there is a deviation in injection amount), a transition to step ST131 is made with an immediately preceding determination mode (a determination mode in the last process routine) held.

In step ST131, it is determined whether or not the current determination mode is "the determination mode 0". If the result of the determination is affirmative (YES) (if the current determination mode is the determination mode 0), a transition to step ST132 is made.

(Abnormality Determination Confirmation Process) In step ST132, the duration time (a time of duration of the state where ΔQ≥Qth00) Ctm00 (milliseconds) is obtained based on a count value of the abnormality counter C00 for the determination mode 00. It is determined whether or not the duration time Ctm00 is equal to or longer than the time threshold Tth00 in the threshold map (for the determination mode 0) of FIG. 8. It should be noted herein that the duration time Ctm00 is the count value of the abnormality counter C00 for the determination mode 00 multiplied by 8 milliseconds (the cycle of the process routine). If the result of the determination in this step ST132 is negative (NO) (if Ctm00<Tth00), a transition to step ST133 is made.

In step ST133, a duration time (a time of duration of the state where ΔQ≥Qth01) Ctm01 (milliseconds) is obtained based on a count value of the abnormality counter C01 for the determination mode 01 (Ctm01=the count value×8 milliseconds). It is determined whether or not the duration time Ctm01 is equal to or longer than the time threshold Tth01 in the threshold map (for the determination mode 0) of FIG. 8. If the result of the determination is negative (NO) (if Ctm01<Tth01), a transition to step ST134 is made.

In step ST134, a duration time (a time of duration of the state where ΔQ≥Qth02) Ctm02 (milliseconds) is obtained based on a count value of the abnormality counter C02 for the determination mode 02 (Ctm02=the count value×8 milliseconds). It is determined whether or not the duration time Ctm02 is equal to or longer than the time threshold Tth02 in the threshold map (for the determination mode 0) of FIG. 8. If the result of the determination is negative (NO) (if Ctm02<Tth02), a return is made. The subsequent process routine is executed after the lapse of a predetermined time (a time equivalent to the cycle of the process routine).

On the other hand, if one of the results of one of the aforementioned steps, namely, step ST132, step ST133 and step ST134 is affirmative (YES), it is determined that there is an abnormality in fuel injection control (an abnormality in computing the command injection amount or an abnormality in driving any one of the fuel injection valves), and an abnormality flag is set (step ST135). When the abnormality flag is set, the microcomputer 21 executes a fail-safe process, and then ends the process.

It should be noted herein that if it is determined in the first abnormality determination process P11 that there is an abnormality in fuel injection control (an abnormality in computing the command injection amount), the microcomputer 21 stops computing the command injection amount Qfin and fixes this command injection amount Qfin to a value that is prescribed in advance, as the fail-safe process. Incidentally, the microcomputer 21 may issue a warning when it is determined that there is an abnormality.

If it is determined that there is an abnormality in fuel injection control (an abnormality in driving any one of the fuel injection valves) in the second abnormality determination process P22, the microcomputer 21 stops the cylinder in which the abnormality has occurred, that is, stops fuel injection in the cylinder, as the fail-safe process. Incidentally, the microcomputer 21 may issue a warning when it is determined that there is an abnormality.

Figure 14:
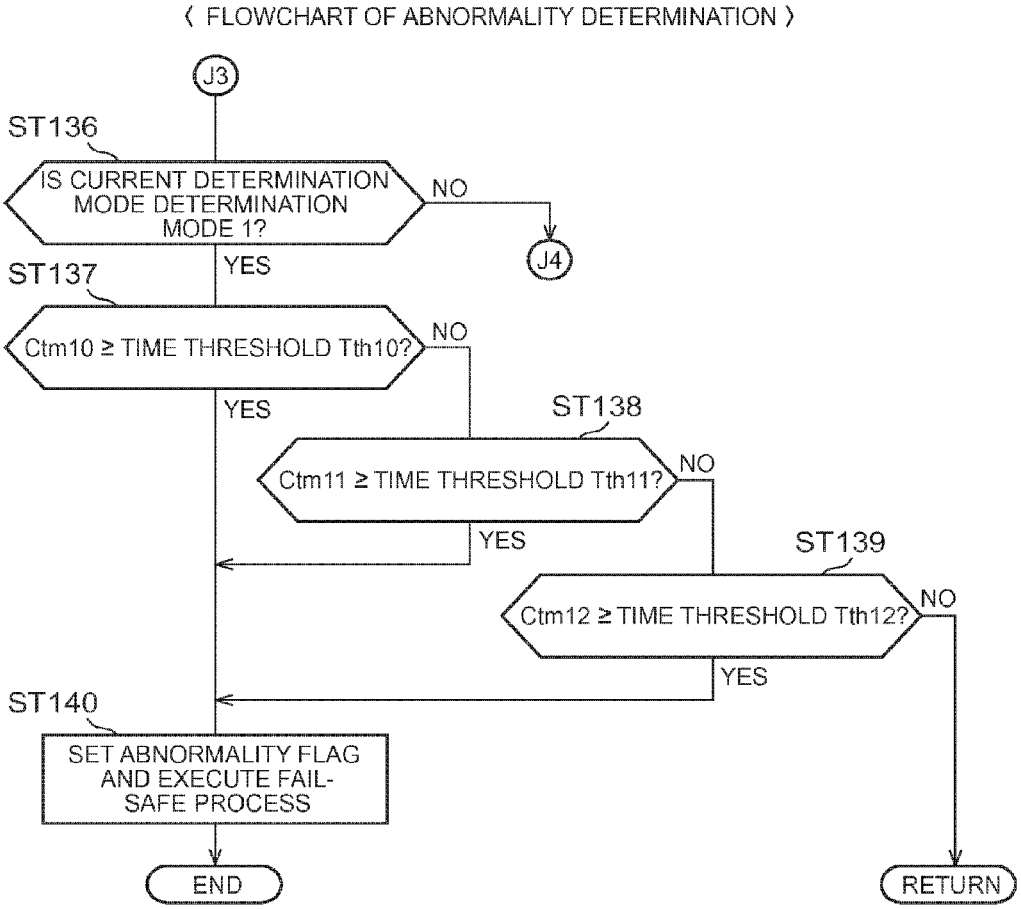
FIG. 14 is a flowchart showing the procedure of an abnormality determination process in the engine control apparatus.

If the result of the determination in the aforementioned step ST131 is negative (NO) (in the case of the determination mode 2), a transition to step ST136 of FIG. 14 is made. In step ST136, it is determined whether or not the current determination mode is "the determination mode 1". If the result of the determination is affirmative (YES) (if the current determination mode is the determination mode 1), a transition to step ST137 is made.

In step ST137, a duration time (a time of duration of the state where ΔQ≥Qth10) Ctm10 (milliseconds) is obtained based on a count value of the abnormality counter C10 for the determination mode 10 (Ctm10=the count value×8 milliseconds).

It is determined whether or not the duration time Ctm10 is equal to or longer than the time threshold Tth10 in the threshold map (for the determination mode 1) of FIG. 9. If the result of the determination is negative (NO) (if Ctm10<Tth10), a transition to step ST138 is made.

In step ST138, a duration time (a time of duration of the state where ΔQ≥Qth11) Ctm11 (milliseconds) is obtained based on a count value of the abnormality counter C11 for the determination mode 11 (Ctm11=the count value×8 milliseconds). It is determined whether or not the duration time Ctm11 is equal to or longer than the time threshold Tth11 in the threshold map (for the determination mode 1) of FIG. 9. If the result of the determination is negative (NO) (if Ctm11<Tth11), a transition to step ST139 is made.

In step ST139, a duration time (a time of duration of the state where ΔQ≥Qth12) Ctm12 (milliseconds) is obtained based on a count value of the abnormality counter C12 for the determination mode 12 (Ctm12=the count value×8 milliseconds). It is determined whether or not the duration time Ctm12 is equal to or longer than the time threshold Tth12 in the threshold map (for the determination mode 0) of FIG. 8. If the result of the determination is negative (NO) (if Ctm12<Tth12), a return is made. The subsequent process routine is executed after the lapse of a predetermined time (a time equivalent to the cycle of the process routine).

On the other hand, if the result of the determination of one of the aforementioned steps, namely, step ST137, step ST138 and step ST139 is affirmative (YES), it is determined that there is an abnormality in fuel injection control (an abnormality in computing the command injection amount or an abnormality in driving any one of the fuel injection valves), and the abnormality flag is set (step ST140). When the abnormality flag is set, the microcomputer 21 executes the fail-safe process of the aforementioned contents, and then ends the process.

Figure 15:
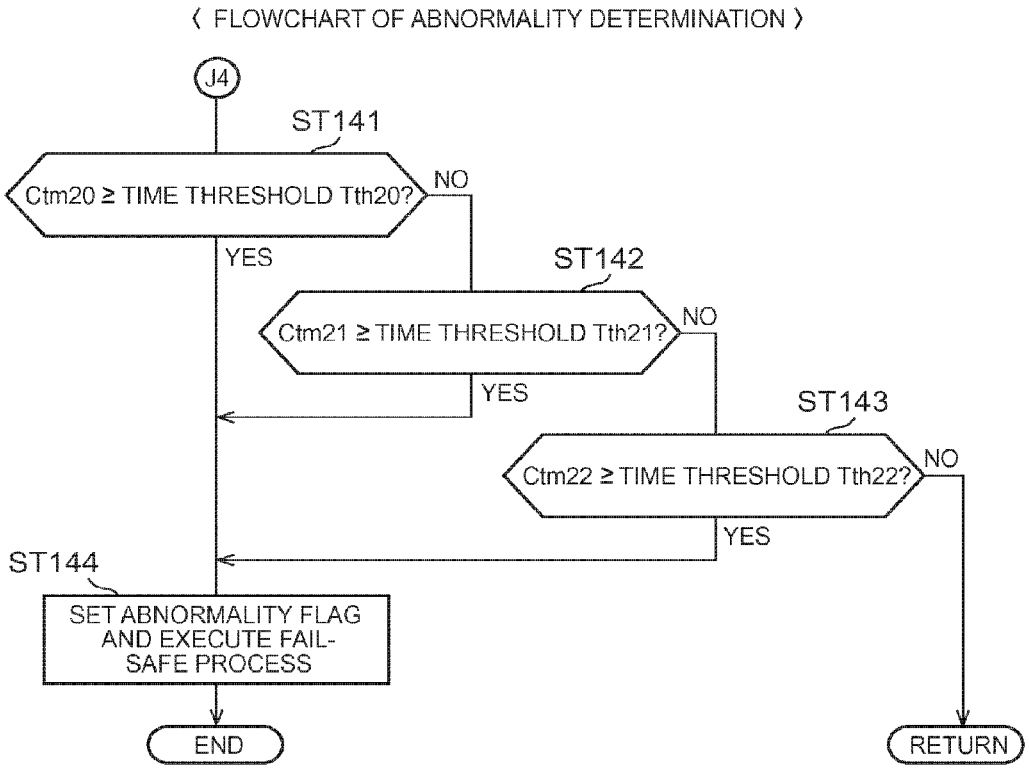
FIG. 15 is a flowchart showing the procedure of an abnormality determination process in the engine control apparatus.

If the result of the determination of the aforementioned step ST136 is negative (NO), a transition to step ST141 in FIG. 15 is made. In step ST141, a duration time (a time of duration of the state where ΔQ≥Qth20) Ctm20 (milliseconds) is obtained based on a count value of the abnormality counter C20 for the determination mode 20 (Ctm20=the count value×8 milliseconds). It is determined whether or not the duration time Ctm20 is equal to or longer than the time threshold Tth20 in the threshold map (for the determination mode 2) of FIG. 10. If the result of the determination is negative (NO) (if Ctm20<Tth20), a transition to step ST142 is made.

In step ST142, a duration time (a time of duration of the state where ΔQ≥Qth21) Ctm21 (milliseconds) is obtained based on a count value of the abnormality counter C21 for the determination mode 21 (Ctm21=the count value×8 milliseconds). It is determined whether or not the duration time Ctm21 is equal to or longer than the time threshold Tth21 in the threshold map (for the determination mode 2) of FIG. 10. If the result of the determination is negative (NO) (if Ctm21<Tth21), a transition to step ST143 is made.

In step ST143, a duration time (a time of duration of the state where ΔQ≥Qth22) Ctm22 (milliseconds) is obtained based on a count value of the abnormality counter C22 for the determination mode 22 (Ctm22=the count value×8 milliseconds). It is determined whether or not the duration time Ctm22 is equal to or longer than the time threshold Tth22 in the threshold map (for the determination mode 0) of FIG. 8. If the result of the determination is negative (NO) (if Ctm22<Tth22), a return is made. The subsequent process routine is executed after the lapse of a predetermined time (a time equivalent to the cycle of the process routine).

On the other hand, if the result of the determination of one of the aforementioned steps, namely, step ST141, step ST142 and step ST143 is affirmative (YES), it is determined that there is an abnormality in fuel injection control (an abnormality in computing the command injection amount or an abnormality in driving any one of the fuel injection valves), and the abnormality flag is set (step ST144). When the abnormality flag is set, the microcomputer 21 executes the fail-safe process of the aforementioned contents, and then ends the process.

Next, the effect achieved by the engine control apparatus according to the present embodiment of the invention will be described. As described previously, according to the present embodiment of the invention, the injection amount threshold for use in a determination on an abnormality in fuel injection control is set such that [the injection amount threshold for the determination mode 0 (the vehicle speed<10 km/h)<the injection amount threshold for the determination mode 1 (10 km/h≤the vehicle speed<30 km/h)<the injection amount threshold for the determination mode 2 (the vehicle speed≥30 km/h)]. That is, the injection amount threshold is set to a value that increases as the vehicle speed rises, in accordance with the vehicle speed. Therefore, it is unlikely to be determined that there is an abnormality in fuel injection control at high vehicle speed. Thus, the fail-safe process, which makes the driver develop a feeling of strangeness at high vehicle speed, can be restrained from being executed. Besides, when the duration time of the state where the injection amount difference between the command injection amount Qfin and the monitoring injection amount (the required injection amount monitoring value Qfinm or the total injection amount monitoring value ΣQM) is equal to or larger than the injection amount threshold is equal to or longer than the time threshold, it is confirmed that there is an abnormality, and the fail-safe process is executed. Therefore, an abnormality in fuel injection control can be confirmed with higher accuracy.

Furthermore, in the present embodiment of the invention, when the injection amount difference between the command injection amount and the monitoring injection amount is equal to or larger than the injection amount threshold, the immediately preceding injection amount threshold is held. Therefore, when the vehicle accelerates in a situation where the injection amount difference between the command injection amount and the monitoring injection amount is equal to or larger than the injection amount threshold, the inconvenience of a correct determination on an abnormality being impossible due to a change in the injection amount threshold before the confirmation of the abnormality, which results from a rise in vehicle speed, can be avoided.

Moreover, in the present embodiment of the invention, the series of processes of the engine control apparatus 20 regarding fuel injection amount control are divided into two groups and monitored individually. Therefore, even when the computation logic for monitoring is simplified, the computation error in individual monitoring is small, so the accuracy in detecting an abnormality is restrained from decreasing. In consequence, according to the engine control apparatus of the present embodiment of the invention, it can be determined with high accuracy whether or not fuel injection amount control is normally performed, while the computation load is held small.

Besides, in the present embodiment of the invention, the fail-safe process is executed in a mode that differs depending on whether it is determined in the first abnormality determination process P11 that there is an abnormality or it is determined in the second abnormality determination process P22 that there is an abnormality. Therefore, the fail-safe process can be more appropriately executed in accordance with the type of the abnormality.

Next, other embodiments of the invention will be described. In the foregoing embodiment of the invention, the three determination modes are set with respect to the vehicle speed, but the invention is not limited thereto. Two determination modes or four or more determination modes may be set to make a determination on an abnormality.

In the foregoing embodiment of the invention, the three injection amount thresholds (Qth) and the three time thresholds (Tth) are set for each one of the determination modes, but the invention is not limited thereto. One injection amount threshold (Qth) and one time threshold (Tth) may be set for each one of the determination modes. Alternatively, two or four or more injection amount thresholds (Qth) and two or four or more time thresholds (Tth) may be set for each one of the determination modes.

In the foregoing embodiment of the invention, the injection amount thresholds and the time thresholds are acquired with reference to the threshold maps in the first abnormality determination process P11 and the second abnormality determination process P22, but the invention is not limited thereto. Those injection amount thresholds and time thresholds may be acquired through computation based on model formulae.

In the foregoing embodiment of the invention, the vehicle speed is estimated based on the accelerator opening degree and the engine rotational speed to make a determination on an abnormality, but the invention is not limited thereto. In the case where the vehicle is mounted with a vehicle speed sensor with guaranteed information on the vehicle speed, the injection amount threshold may be set in such a manner as to increase as the vehicle speed rises, based on the actual vehicle speed detected by the vehicle speed sensor.

In the foregoing embodiment of the invention, when the difference between the command injection amount and the monitoring injection amount is equal to or larger than the injection amount threshold, it is determined that there is an abnormality in fuel injection control, but the invention is not limited thereto. For example, when the ratio between the command injection amount and the monitoring injection amount is equal to or larger than the injection amount threshold, it may be determined that there is an abnormality in fuel injection control.

In the foregoing embodiment of the invention, the case where the invention is applied to the engine control apparatus for the diesel engine that is mounted in the vehicle has been described. The invention is not limited to this case, but is also applicable to an engine control apparatus for a gasoline engine.

It should be noted herein that a determination process unit that makes a determination on an abnormality in the fuel injection control based on the vehicle speed-associated parameter may be provided, and that the determination may be made based on a determination criterion that is more unlikely to lead to a determination that there is an abnormality when the vehicle speed-associated parameter is a value corresponding to a case where the vehicle speed is high than the vehicle speed-associated parameter is a value corresponding to a case where the vehicle speed is low, in the invention.

The invention is available for an engine control apparatus for a diesel engine or the like. More specifically, the invention is effectively available for an engine control apparatus that can determine whether or not fuel injection control is normally performed.

What is claimed is:

1. An engine control apparatus comprising:

a fuel injection amount computation unit that is configured to compute a command injection amount based on an operation state of an engine;

a first determination process unit that is configured to (i) obtain a monitoring injection amount that monitors a function of computing the command injection amount, and (ii) make a determination on an abnormality in fuel injection control when a deviation between the command injection amount and the monitoring injection amount is equal to or larger than an injection amount threshold, the injection amount threshold being set larger based on a vehicle speed-associated parameter when the vehicle speed-associated parameter is a value corresponding to a case where a vehicle speed is high than when the vehicle speed-associated parameter is a value corresponding to a case where the vehicle speed is low; and an engine abnormality process unit that is configured to take an engine abnormality countermeasure when there is an abnormality in the fuel injection control of the engine.

2. The engine control apparatus according to claim 1, wherein the first determination process unit is configured to (i) use an accelerator opening degree as the vehicle speed-associated parameter, and (ii) set the injection amount threshold larger when the accelerator opening degree is large than when the accelerator opening degree is small.

3. The engine control apparatus according to claim 1, wherein the first determination process unit is configured to (i) use an engine rotational speed as the vehicle speed-associated parameter, and (ii) set the injection amount threshold larger when the engine rotational speed is high than when the engine rotational speed is low.

4. The engine control apparatus according to claim 1, wherein the first determination process unit is configured to confirm that there is an abnormality when a duration time of a state where the deviation between the command injection amount and the monitoring injection amount is equal to or larger than the injection amount threshold is equal to or longer than a time threshold, and the engine abnormality process unit is configured to take the engine abnormality countermeasure based on the confirmation of the first determination process unit.

5. The engine control apparatus according to claim 1, wherein the first determination process unit is configured to hold an immediately preceding injection amount threshold when the deviation between the command injection amount and the monitoring injection amount is equal to or larger than the injection amount threshold.

6. An engine control apparatus comprising: a fuel injection amount computation unit that is configured to compute a command injection amount based on an operation state of an engine; a determination process unit that is configured to (i) obtain a monitoring injection amount that monitors a function of driving a fuel injection valve based on the command injection amount, and (ii) make a determination on an abnormality in the fuel injection control when a deviation between the command injection amount and the monitoring injection amount is equal to or larger than an injection amount threshold, the injection amount threshold being set larger based on a vehicle speed-associated parameter when the vehicle speed-associated parameter is a value corresponding to a case where a vehicle speed is high than when the vehicle speed-associated parameter is a value corresponding to a case where the vehicle speed is low; and an engine abnormality process unit that is configured to take an engine abnormality countermeasure when there is an abnormality in the fuel injection control of the engine.

7. The engine control apparatus according to claim 6, wherein the determination process unit is configured to (i) use an accelerator opening degree as the vehicle speed-associated parameter, and (ii) set the injection amount threshold larger when the accelerator opening degree is large than when the accelerator opening degree is small.

8. The engine control apparatus according to claim 6, wherein the determination process unit is configured to (i) use an engine rotational speed as the vehicle speed-associated parameter, and (ii) set the injection amount threshold larger when the engine rotational speed is high than when the engine rotational speed is low.

9. The engine control apparatus according to claim 6, wherein the determination process unit is configured to confirm that there is an abnormality when a duration time of a state where the deviation between the command injection amount and the monitoring injection amount is equal to or larger than the injection amount threshold is equal to or longer than a time threshold, and the engine abnormality process unit is configured to take the engine abnormality countermeasure based on the confirmation of the first determination process unit.

10. The engine control apparatus according to claim 6, wherein the determination process unit is configured to hold an immediately preceding injection amount threshold when the deviation between the command injection amount and the monitoring injection amount is equal to or larger than the injection amount threshold.

11. An engine control apparatus comprising:

a fuel injection amount computation unit that is configured to compute a command injection amount based on an operation state of an engine;

a first determination process unit that is configured to (i) obtain a monitoring injection amount that monitors a function of computing the command injection amount, (ii) make a determination on an abnormality in fuel injection control based on a vehicle speed-associated parameter, and (iii) make the determination based on a determination criterion that is more unlikely to lead to a determination that there is an abnormality, when the vehicle speed-associated parameter is a value corresponding to a case where a vehicle speed is high than when the vehicle speed-associated parameter is a value corresponding to a case where the vehicle speed is low; and an engine abnormality process unit that is configured to take an engine abnormality countermeasure when there is an abnormality in the fuel injection control.

12. The engine control apparatus according to claim 11, wherein the first determination process unit is configured to (i) use an accelerator opening degree as the vehicle speed-associated parameter, and (ii) set the injection amount threshold larger when the accelerator opening degree is large than when the accelerator opening degree is small.

13. The engine control apparatus according to claim 11, wherein the first determination process unit is configured to (i) use an engine rotational speed as the vehicle speed-associated parameter, and (ii) set the injection amount threshold larger when the engine rotational speed is high than when the engine rotational speed is low.

14. An engine control apparatus comprising: a fuel injection amount computation unit that is configured to compute a command injection amount based on an operation state of an engine; a determination process unit that is configured to (i) obtain a monitoring injection amount that monitors a function of driving a fuel injection valve based on the command injection amount, (ii) make a determination on an abnormality in fuel injection control based on a vehicle speed-associated parameter, and (iii) make the determination based on a determination criterion that is more unlikely to lead to a determination that there is an abnormality, when the vehicle speed-associated parameter is a value corresponding to a case where a vehicle speed is high than when the vehicle speed-associated parameter is a value corresponding to a case where the vehicle speed is low; and an engine abnormality process unit that is configured to take an engine abnormality countermeasure when there is an abnormality in the fuel injection control.

15. The engine control apparatus according to claim 14, wherein the determination process unit is configured to (i) use an accelerator opening degree as the vehicle speed-associated parameter, and (ii) set the injection amount threshold larger when the accelerator opening degree is large than when the accelerator opening degree is small.

16. The engine control apparatus according to claim 14, wherein the determination process unit is configured to (i) use an engine rotational speed as the vehicle speed-associated parameter, and (ii) set the injection amount threshold larger when the engine rotational speed is high than when the engine rotational speed is low.

* * * * *